US009828072B2

(12) United States Patent
Gallagher

(10) Patent No.: US 9,828,072 B2
(45) Date of Patent: Nov. 28, 2017

(54) COMPACT FLOATING PRODUCTION, STORAGE AND OFFLOADING FACILITY

(71) Applicant: ATKINS LIMITED, Surrey (GB)

(72) Inventor: Paul Gallagher, Sussex (GB)

(73) Assignee: ATKINS LIMITED, Surrey (GB)

( * ) Notice: Subject to any disclaimer, the term of this patent is extended or adjusted under 35 U.S.C. 154(b) by 0 days.

(21) Appl. No.: 14/890,682

(22) PCT Filed: May 1, 2014

(86) PCT No.: PCT/GB2014/051364

§ 371 (c)(1),
(2) Date: Nov. 12, 2015

(87) PCT Pub. No.: WO2014/184520

PCT Pub. Date: Nov. 20, 2014

(65) Prior Publication Data

US 2016/0083053 A1 Mar. 24, 2016

(30) Foreign Application Priority Data

May 15, 2013 (GB) ..... 1308798.6

(51) Int. Cl.
*B63B 35/44* (2006.01)
*B63B 39/03* (2006.01)

(52) U.S. Cl.
CPC ..... *B63B 35/44* (2013.01); *B63B 35/4413* (2013.01); *B63B 39/03* (2013.01); *B63B 2035/442* (2013.01); *B63B 2035/448* (2013.01)

(58) Field of Classification Search
CPC ..... B63B 35/44; B63B 35/4413; B63B 2035/442; B63B 2035/448; B63B 39/03; B63B 39/06; B63B 2039/067
See application file for complete search history.

(56) References Cited

U.S. PATENT DOCUMENTS 3,360,810 A * 1/1968 Busking ..... B63B 22/021 114/256
4,606,673 A * 8/1986 Daniell ..... B63B 22/021 114/256
5,722,797 A * 3/1998 Horton, III ..... B63B 35/4406 114/264

(Continued)

FOREIGN PATENT DOCUMENTS

EP 0 256 177 2/1988
GB 2 253 813 9/1992

(Continued)

OTHER PUBLICATIONS

ISA/EP; PCT International Search Report and Written Opinion, dated Jul. 28, 2014 re: PCT/GB2014/051364.

(Continued)

*Primary Examiner* — Ajay Vasudeva
(74) *Attorney, Agent, or Firm* — Louis Woo

(57) ABSTRACT

An oil storage apparatus (111) comprising a buoyant hull (102) comprising a single column of circular or polygonal cross-section. The interior of said hull (102) comprises at least one oil-over-water tank (103), and said oil storage apparatus (111) further comprises means for maintaining said tank in pressed full condition.

18 Claims, 4 Drawing Sheets

(56) References Cited

U.S. PATENT DOCUMENTS 6,854,933 B2 * 2/2005 Horton, III ..... B63B 21/502
114/264
8,973,514 B2 * 3/2015 Hannus ..... B63B 35/4406
114/264

FOREIGN PATENT DOCUMENTS

WO WO 02/087964 11/2002
WO WO 2009/136799 11/2009

OTHER PUBLICATIONS

IPEA/EP: International Preliminary Report on Patentability (including Annexes), dated Aug. 6, 2015 re: PCT/GB2014/051364.

* cited by examiner

COMPACT FLOATING PRODUCTION, STORAGE AND OFFLOADING FACILITY

The present invention relates to an oil storage apparatus such as a floating production, storage and offloading vessel (FPSO) as used for the offshore production and processing of oil and gas reserves, and more specifically, but not exclusively, to an innovative compact hull design which enables operation in harsh environments at low capital cost and suitable for, but not limited to, fields with low production rates, including those that are nearing the end of their life, i.e. marginal field production.

FPSOs are a well-established form of floating offshore platform. They are either purpose built vessels or are converted from oil tankers or the like and are predominantly ship-shaped. FPSOs comprise oil and gas processing facilities which typically consist of the removal and treatment of gases, oil water separation, water treatment, gas compression, fluid and gas re-injection, power generation and distribution and may be built into modules that are situated on the main deck of the vessel and arranged according to space, weight and safety considerations. Crude oil product is stored in stabilised form, at atmospheric pressure, in cargo tanks beneath the process deck of an FPSO, prior to said product periodically being offloading on to shuttle tankers or moved to pipelines. The cargo tanks are kept separate from water ballast tanks which are used to control the draft and stability of an FPSO as the cargo tanks are filled and emptied.

An FPSO is moored in an oil field in a location that allows connection to well-heads via risers through which reservoir fluids, a mixture of crude oil, water, and gas, are delivered. In benign environments, FPSOs are most commonly spread moored with wire, chains, or other conventional arrangements such as drag anchors or suction caissons deployed against the seabed. Typically, the various risers, flow lines and umbilical lines that connect the FPSO to the various wells on the seabed for transfer of the well fluids to the FPSO and to provide power, control and re-inject fluids from the FPSO, may be attached permanently along the side of said FPSO. In such cases, the orientation of the FPSO does not change due to tide, wind and/or currents.

However, where wind and wave action can result in significant ship motions, or the tides are driving changes in the heading of the FPSO, moorings and risers may be arranged through a mechanical turret system that is integrated with the hull. The FPSO is able to rotate around the turret according to environmental loads, and its position may be further controlled using thrusters. Mechanical turrets represent a significant capital cost in the construction of an FPSO for use in harsh environments.

Conventional FPSOs also have significant advantages over fixed offshore production facilities. For example, FPSOs are particularly effective in remote or deepwater locations, where they eliminate the need to lay expensive long-distance pipelines from the processing facility to an onshore terminal. This enables smaller oil fields, which may become exhausted over relatively short periods of time, to be economically viable sources. Furthermore, once a field is depleted, the FPSO can be moved to a new location. Thus, for certain sizes and locations of oil fields where oil production rates and the size of the reserves available are sufficient, the capital cost of investment in an FPSO, or its equivalent charter rate, may be returned in a relatively short period.

Alternative hull shapes for FPSOs exist. These include the circular hull form of Sevan Marine which removes the complexity and cost of the turret mooring system, and the Ramform hull shape which was originally based upon the Norwegian naval intelligence vessel Marjata and which is designed to improve motions and lower costs.

A significant element of a traditional FPSO's ability to provide a safe and stable platform in harsh environments stems from its size and displacement. However, the size of a traditional FPSO must be traded-off against the oil field size it is to be deployed in. A minimum oil field size exists, below which conventional FPSOs become uneconomic and impractical for use. Furthermore, simply reducing the size of a conventional FPSO such that capital costs are reduced and said FPSO becomes an economically viable option for deployment at small and marginal oil fields will result in an FPSO unable to cope in harsh environments. The motion response to wave action of the FPSO increases as its size is reduced and this ultimately affects the operability of the production facilities. A second significant factor is that large capital items such as the aforementioned turret mooring system, and on-deck oil production facilities, do not scale conveniently with size, and ultimately dominate cost. Other operational costs, for example manning and maintenance costs, may similarly fail to fall in line with the size of the facility and revenues that can be achieved from the oil field.

A number of concepts for floating production units (FPUs) that are not ship-shaped, are known. Predominately, these are developed to provide stable platforms that are relatively insensitive to wave action. Examples include semi-submersibles, tension-leg platforms (TLPs) and deep water platform supporting structures known as a spar or Deep Draft Caisson Vessels (DDCVs). Each of these seek to de-tune the resonant motion characteristics of the platform away from the peaks in the local wave energy spectrum, through various hull dimensions and shape, water-plane characteristics and hydrodynamic factors.

In general however, none of these platform concepts provide the large volumes of crude oil storage that are fundamental to the basis of design of an FPSO. However, one common factor is that they have elements of symmetry in their hull forms which makes them relatively insensitive to wave and current direction and have no need for turret mooring systems.

The Sevan Marine circular FPSO design mentioned previously (U.S. Pat. No. 6,945,736) addresses the fundamental issue around the need for a turret mooring system by using a circular plan-form for the hull. Risers and flow-lines are led up through a central moon-pool, and the vessel is able to use a conventional arrangement of fixed mooring lines. Sevan FPSOs provide storage for the stabilised crude oil in conventional storage tanks that are segregated from the vessel's water ballast system. Process facilities and accommodation may be arranged on its upper deck in a manner similar to that of ship-shaped FPSOs.

The hydrostatic stability of the Sevan FPSO concept relies substantially on its water-plane area, second moment of inertia, and control of the vertical position of the centre of mass. The centre of buoyancy of the Sevan FPSO is lower than its centre of mass, as is the case for a conventional ship. Similarly, stability may be reduced by the free-surface effect of the stored crude oil and water ballast, and the overall draft of the vessel varies with loading condition as it would with conventional FPSOs. The hull of the Sevan FPSO has natural periods of heave and pitch motions which are of a similar value to larger ship-shaped FPSOs, though still within the range of harsh environment sea states. To achieve this, the Sevan FPSO includes a large skirt structure at the keel level that acts to enhance hydrodynamic added mass and damping, and improve motion response.

Further prior art in this area is represented by the spar platform FPU concept, or DDCV, which is substantially the same. The spar or DDCV consists of a circular cylinder orientated vertically such that its draft is significantly greater than its diameter. There are a number of variants on this concept, all being of deep draft or Truss-spar in type (for example U.S. Pat. Nos. 6,227,137, 6,564,741, 7,565,877, and 6,263,824).

The contribution to the hydrostatic stability of a spar from its water-plane is not significant, and hence it is so arranged that its centre of mass is significantly lower than its centre of buoyancy. This is achieved by the use of very large amounts of fixed ballast located at its base or keel. There are a number of variants on this theme, including truss spars, for which the common approach to managing response in waves is to ensure that the natural periods in heave and pitch are high, i.e. above 20 seconds, and away from the peaks in local wave energy spectra. This is significantly higher than would be the case for either a normal ship-shaped FPSO or the Sevan FPSO design.

It should also be noted that spars or DDCVs are also designed to minimise wave excitation by having a deep draft. Wave pressure reduces exponentially with increasing water depth, and by ensuring that the bottom of the platform is maintained deep below the water surface, the amplitude of the varying excitation wave pressure is reduced significantly over that experienced by conventional ships of shallower draft.

The spar concept has been used primarily with conventional designs of topside process facilities based on multi-decked modular structures. In general however, they have not been designed to store crude oil in a manner that would provide the same capability and as FPSO.

The spar concept has also been used as an oil storage and offloading facility (for example the Shell Brent spar), but without the capacity to support the weight of a topside production facility, and using a system of segregated oil storage and water ballast tanks.

The spar or DDCV concept is also known to have relatively low damping and hydrodynamic added mass in heave, and so it is relatively common to add damping and hydrodynamic added mass through the addition of horizontal heave plates. Additional damping is provided by fluid vortex shedding at the edges of the heave plates and/or by providing additional holes across said plates through which water is forced. Further resistance and energy dissipation is generated through viscous effects. This action is similar in all such respects to traditional bilge keels on ships, or skirts on Catenary Anchor Leg Mooring (CALM) buoys or semi-submersible platforms. The addition of hydrodynamic added mass by heave plates also has the effect of increasing the overall mass inertia and hence increasing natural periods of motion.

A further example of prior art is represented by the Mono-Column FPSO (U.S. patent application Ser. No. 12/294,192). This invention features a central oil storage tank with surrounding buoyant hull and ballast spaces, some of which are open to the sea, the object of which is, in part, to provide additional damping in association with a large additional bilge keel, similar to that employed by the Sevan FPSO design. It is also of symmetric design and arranged as a series of vertical cylinders, which have the largest diameter at the keel, reducing in diameter vertically, with the smallest diameter being at the water-plane.

Thus, the need exists for low cost forms of FPSO that are durable and achieve a reduced rolling and pitching movement and also reduced heave motion whilst being of a size that means said FPSO can cost effectively be deployed and re-deployed in small, relatively short-life, marginal and stranded oil fields.

Unlike the Mono-Column FPSO, or any other similar concepts, the present invention uses oil-over-water storage, maintained in a pressed full condition (i.e. there is no air or vapour above the liquid in the tank), and is thus able to reduce significantly the total volume of the hull and materials. It also has a different hull form, with the largest overall diameter at the water surface, reducing with distance from the water line, the purpose of which is to both ensure that the centre of buoyancy is high, but also that the water-plane is of particular dimensions that will both contribute to stability and yet ensure a high heave natural period.

Furthermore, the conventional approach to storing oil in both oil tankers, FPSOs and FSOs (Floating Storage and Offloading Facilities) is to use segregated crude oil and water ballast tanks.

The compact FPSO of the present invention employs the oil-over-water approach to stabilised crude oil storage. This method is commonly used in subsea storage facilities or sea-bed tanks, with recent examples being found on the Siri, YME, and Solan fields in the North Sea. However, no floating production facilities or FPSOs are operating with oil-over-water storage tanks being the basis of their design. The Octabuoy semi-submersible, as developed by Moss-Maritime (U.S. Pat. No. 7,117,810) has been provided with an oil-over-water storage capability within each of its four columns. The manner of intended operation provides for a direct link between the lower sea-water zone in each tank and the external environment, via a series of cells designed to detect and/or trap any higher than acceptable levels of oil to mitigate the pollution hazard. This is the same approach as taken on some existing traditional sea-bed tanks. The inclusion of this oil storage facility is not fundamental to the Octabuoy concept as a "dry tree" semi-submersible.

The compact FPSO of the present invention also uses oil-over-water as a means of storage of the produced crude oil product, but does not involve a direct connection to the sea, and is therefore different from traditional sea-bed tanks and the Octabuoy concept. The present invention has been conceived such that the control of the pressed full oil-over-water storage tank requires that an internal water caisson is used to manage pressure, and that the displaced water from the tank may be cleaned and/or used for water injection, and not exposed directly to the sea. This also allows hydrostatic pressure within the tank to be higher than that given by the external sea level or operating draft. This method of oil-over-water oil storage is inherent to the concept through its influence over hull form and weight distribution in a way that is not found in other forms of FPSO.

According to a first embodiment of the present invention, there is provided an oil storage apparatus, comprising;

a buoyant hull comprising a single column of circular or polygonal cross-section, wherein the interior of said hull comprises at least one oil-over-water tank, and said oil storage apparatus further comprises means for maintaining said tank in pressed full condition.

Unlike the prior art, the present invention uses an oil-over-water storage maintained in a pressed full condition, and is therefore able to reduce significantly the total volume of the hull and thus the material of said hull.

Preferably, the single column comprises two or more vertically stacked cylinders and advantageously, a first region of the hull is, in use, proximate the waterline, and a second region of the hull is, in use, ultimate from the waterline such that the diameter of said hull reduces from a maximum at the first region to a minimum at the second region. Thus, the hull may also be of a different form to the prior art, with the largest overall diameter at the water surface and said diameter reducing with the distance from the water surface. The purpose of such a shape is to ensure that the centre of buoyancy is as high as possible, whilst the water-plane is of particular dimensions that will both contribute to stability and ensure a high heave natural period. The oil storage apparatus may be arranged such that the centre of buoyancy and centre of mass are substantially coincident.

Preferably, the at least one oil-over-water tank is enclosed and substantially isolated from the external atmosphere. The tank may also be fitted with a vapour and gas venting arrangement such that said tank is inherently safer from the risk of explosion or fire.

Advantageously, the oil-over water tank is provided about the central vertical axis of said hull and a water caisson may be provided in fluid communication with said oil-over-water tank. The water caisson may be arranged so as to enable control of the pressure in the oil-over-water tank by controlling the level of water in said water caisson. Further advantageously, the water caisson is arranged such that, in use, water displaced from the oil-over-water tank is not exposed directly to the sea. The displaced water may be cleaned and or used for water injection.

At least one water pump may be provided within the present invention so as to enable the filling or emptying of the oil-over-water tank and water caisson and, preferably, the water caisson extends through an upper most deck of the hull to connect to water treatment facilities located thereon.

Preferably, the present invention further comprises a crude oil caisson which fluidly connects the oil-over-water tank to a main process topsides facility. The produced crude oil may be transferred to and from the oil-over-water tank via said crude oil caisson to the upper part of the tank and the pressure within the tank indicated or controlled by the level of oil in the caisson.

Advantageously, the buoyancy of the hull is provided by internal spaces arranged around the oil-over-water tank. Collision bulkheads may be provided within the internal spaces such that watertight subdivision of said spaces is possible.

At least one water ballast tank may be provided around the oil-over-water tank and said at least one water ballast tank may, preferably, be provided proximate the centre of mass of the oil-over-water tank. The locations of the water ballast tanks minimise variations in the centre of mass of the liquids contained in the oil-over-water tanks. Preferably, at least one water ballast tank is provided below the centre of mass of the oil-over-water tank. Further advantageously, at least one water ballast tank is provided above the centre of mass of the oil-over-water tank.

A ballast keel may be provided beneath the hull of the present invention in order to improve stability. At least one substantially horizontally oriented heave plate may, advantageously, be arranged on the keel and said at least one substantially horizontally oriented heave plate may be provided proximate to the base of said keel. Further advantageously, a gap between the at least one heave plate and the hull may be provided, said gap arranged such that, in use, water can flow therethrough. The heave plate located proximate the base of the keel reduces wave loading whilst retaining added mass and motion damping effects. The at least one heave plate may be perforated. Perforations and or a gap between the heave plate and the hull enable water to flow through and around the heave plate or plates. Flow in this manner generates turbulent vortices from the edges of the plates which provide a damping effect.

Fixed solid ballast may be positioned proximate the keel. Preferably, the fixed solid ballast is provided such that the centre of mass of the oil storage apparatus is substantially coincident with, or below the centre of buoyancy of said oil storage apparatus. This improves the stability of said oil storage apparatus, which is of particular concern when deployed in harsh environments.

Advantageously, the upper most deck of the hull is symmetric in shape. The upper deck may have eight, twelve or sixteen sides, or may be circular. This ensures that said deck is relatively insensitive to wind, wave and current direction.

In a second preferred embodiment, at least one oil-water separation cell may be positioned proximate the upper portion of the oil-over-water storage tank. Preferably, the at least one separation cell is of sufficient volume to ensure, in use, separation of the oil and water therein through gravity. At least one baffle or weir may be arranged in the separation cell to form at least one zone through which, in use, oil and water may flow. The production fluids may be directed through the separation cell and sequence of zones therein such that the oil has sufficient time to rise and separate from the water and may be skimmed off the top of said water and transferred to a further oil caisson fluidly connected to the oil-over-water tank. Water may be drawn off at the lower level of said separation cell and transferred to a suitable water clean-up facility, for example located on the topside of the upper most deck of the hull. Accordingly, an oil caisson may fluidly connect the at least one separation cell with the oil-over-water storage tank.

Advantageously, the separation cell further comprises a heating arrangement and may further comprise insulation such that the temperature of the contents of the cell or cells may be controlled according to the specific needs of the fluids being separated.

Preferably, the at least one separation cell is arranged such that at a suitable point, the crude oil layer therein spills into the oil filled caisson, with an equivalent amount of seawater being removed from the water caisson leg of the system to allow the oil to fill the storage tank. The separated production water may be recycled to the topsides for treatment before disposal by re-injection or disposed overboard according to environmental requirements. This additional stage of oil-water separation provides the potential to reduce the cost of the facility by removing the need for certain traditional separation vessels on the process topsides.

Typical dimensions for the oil storage apparatus of either the first or second embodiment may range from, in use, a draft from the water surface to the base of the keel of between substantially 60 and 90 meters; a maximum width of the hull of preferably between substantially 38 and 45 meters and a freeboard of preferably between substantially 15 and 20 meters. The oil-over-water tank may run from proximate the base of the FPSO to, in use, substantially 10 meters above the waterline and said oil-over-water tank may be approximately 20 to 25 meters in width when viewed from above. These dimensions will typically depend on the specific requirements of the field for oil storage capacity, and the operating weight and height of the processing facilities.

Oil and water processing facilities may be provided on the upper most deck of the hull of either the first or second embodiment in modular, multi-decked arrangements and the water-plane area of the hull is preferably such that, in combination with the displaced mass, hydrodynamic mass, and damping, natural periods in heave and pitch degrees of freedom are maintained at or above 20 seconds.

Modular power generation facilities are preferably installed using a single or multi-decked structure stabbed-in to the hull and spaces are further preferably arranged about the oil-over-water tank to enable the storage of equipment and or provide routes for piping and or chain lockers.

Advantageously, the centre of mass of either embodiment is proximate the centre of buoyancy. With regard to motion response in waves, the heave natural period depends on the water-plane area, which provides the spring stiffness through changes in buoyancy, and the total mass. The total mass is the sum of the mass displacement of the oil storage apparatus and the hydrodynamic added mass. The latter is affected significantly by the use of heave plates to increase hydrodynamic added mass and hence increase natural period. Damping also has the subtle effect of increasing natural period and heave plates may be used to provide additional damping through the effect of viscous drag.

In operation, the oil-over-water storage tank of either embodiment may be filled with stabilised crude oil during production and said oil offloaded by employing a "U-tube" arrangement. A first leg of the U-tube may comprise one or more oil filed caissons connected to the top of the storage tank and extending above said tank. The storage tank may be filed and oil may be exported through said one or more caissons. The second leg of the U-tube may be formed by one or more caissons connected to the base of the storage tank from which, in use, the level of sea-water in the storage tank is controlled. The tank may form the link between the two legs of the U-tube and the water level in the water caisson may be controlled so as to manage the oil level in the oil caisson, or visa-versa, during use. The oil level in the oil caisson may be maintained above the top of the storage tank to ensure said tank remains pressed full.

With regard to the static stability of the oil storage apparatus, the following relationship exists:

$$GM=KB+BM-KG$$

GM is the metacentric height—a direct measure of the stability or resistance to heeling moments expressed as a distance between the centre of mass and the metacentre. If KB, the centre of buoyancy of the FPSO and KG, the centre of mass of the FPSO, are close together, KB minus KG is close to zero. In the compact FPSO, this state is maintained through the use of the oil-over-water storage philosophy and the water ballast system described herein to maintain substantially constant draft. Therefore BM, the second moment of area of the water-plane divided by the displaced volume, dominates GM and the static stability of the compact FPSO. The correct selection of water-plane area and overall dimensions to maintain a high heave natural period, and yet provide adequate stability, is a critical differentiator of this invention from the prior art.

This may be achieved substantially by consideration of the two relationships arising from consideration of stability as discussed above and heave natural period for a floating body.

The quantity BM, and therefore GM in this case, is defined as:

$$GM=BM=I/V$$

Where:

I=the second moment of area of the water-plane

V=the displaced volume of the hull

The heave natural period $T_H$ is given, for an un-damped system, by:

$$T_H=2\pi(\rho V(1+k)/\rho g A_w)^{1/2}$$

Where:

ρ=the density of the surrounding fluid g=the acceleration due to gravity $A_w$=the water-plane area cut by the hull at the water line.

k=the hydrodynamic added mass coefficient for heave

It can be shown that these two equations may be combined to provide a relationship between the water-plane area, the heave natural period and metacentric height for any shape of water-plane. For example, for the case of a circular water-plane of radius R, where:

$$I=\tfrac{1}{4}\cdot R^2\cdot A_w=\tfrac{1}{4}\cdot\pi\cdot R^4$$

We obtain the expression:

$$GM\cdot T_H^2=\pi(1+k)\cdot A_w/g$$

From the above expression, given suitable design criteria for GM and $T_H$, the area of the water-plane may be derived for a given value of k. The value of k is dependent on the shape of the hull, the use of heave plates and or other devices. It should be noted that the effect of damping on the natural period may also be included in this formulation. It should also be noted that this relationship is independent of draft, which is due to the previous property that the centre of mass and the centre of buoyancy are chosen to be substantially coincident. A substantially similar expression may be derived for any shape of water-plane.

For the present invention, the above general form of relationship is used within certain tolerances to ensure that the requirements for stability and heave natural period are substantially maintained as the design of the hull form evolves to meet requirements such as oil storage capacity, topsides weight and environmental factors.

It is advantageous that this form of relationship be applied in order to achieve a solution with weight, space and cost advantages over other alternatives and/or the prior art. For example, adequate stability might be achieved by providing fixed solid ballast and lowering the centre of gravity in the manner of a SPAR. But this requires increased buoyancy to compensate, which increases volume, draft, steel weight and cost. Alternatively, stability may be achieved with a higher centre of gravity and less fixed ballast weight through increasing water-plane area and the quantity BM, but this will tend to reduce the natural period below values deemed desirable.

Preferably the oil storage apparatus is a floating production, storage and offloading (FPSO) facility.

According to a further aspect of the present invention, there is provided a method of using the apparatus of the first or second embodiment, wherein oil drawn into the oil-over-water tank is maintained in pressed full condition. Advantageously, an internal water caisson is used to manage the pressure in the oil-over-water tank. The water displaced from the oil-over-water tank may be cleaned and said cleaned water may be used for water injection.

In order that the invention may be more readily understood, reference will now be made, by way of example, to FIGS. 1 to 4, in which.

Figure 1:
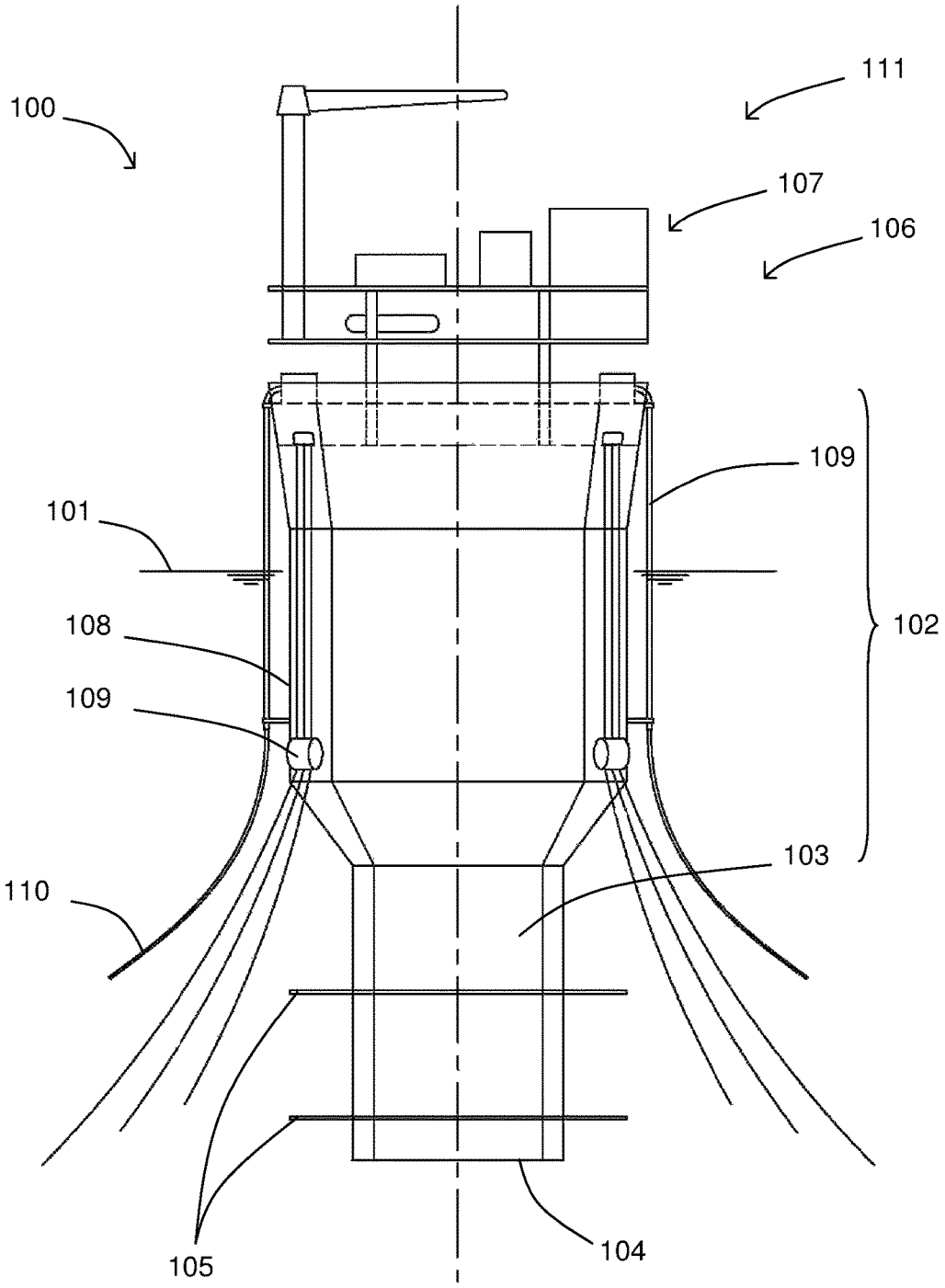
FIG. 1 is a side view of a first embodiment of the present invention.
Figure 2:
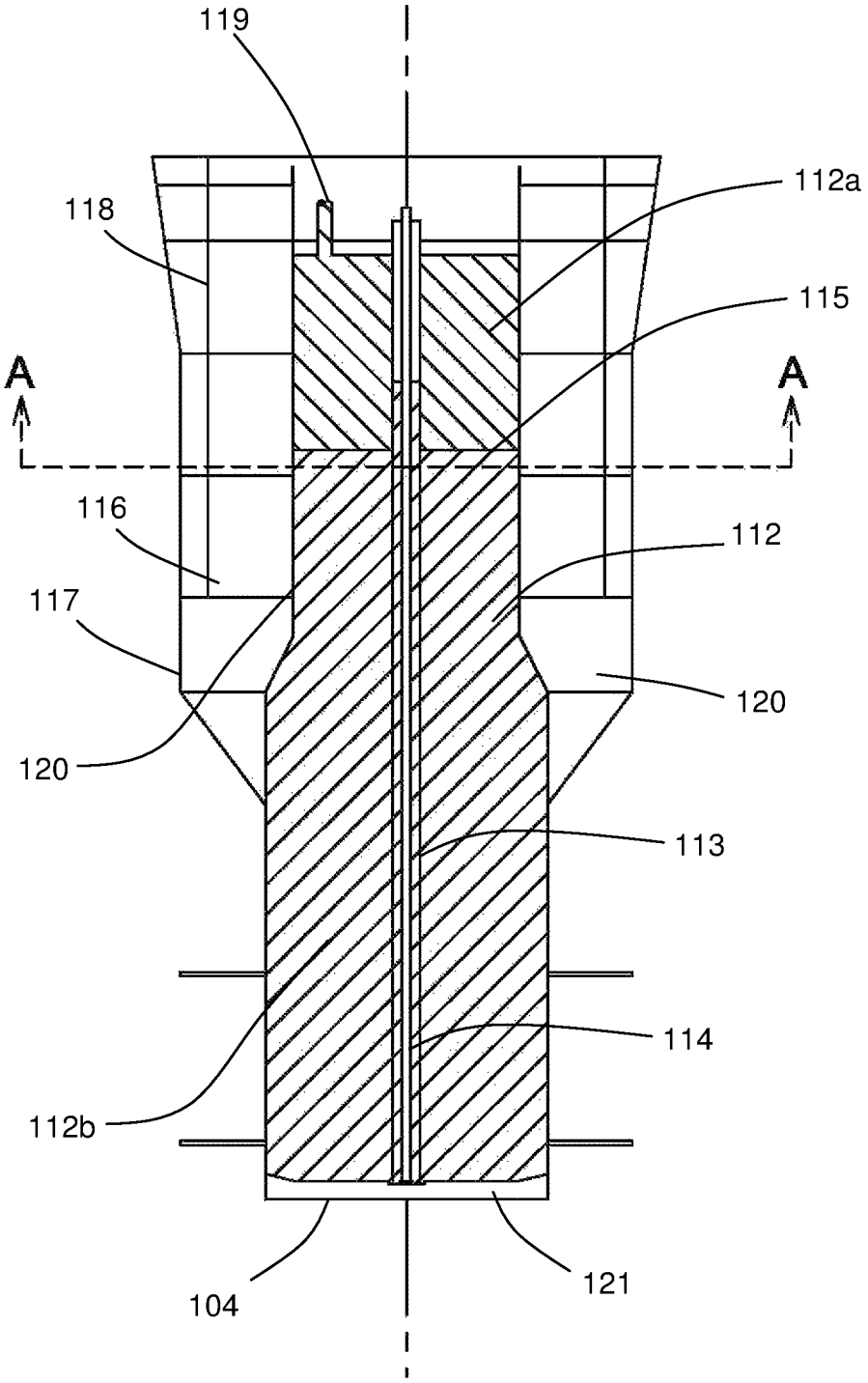
FIG. 2 is a cut-away side view of the embodiment of FIG. 1.

A first embodiment of the invention will now be described with reference to FIGS. 1 to 3. Referring firstly to FIG. 1, a side elevation of the first embodiment of the invention is shown, with a mooring system, flexible risers, flow-lines and umbilicals attached.

The FPSO 100 comprises four sections. The first section is an inwardly tapering column and sits atop a second, cylindrical, section with substantially vertical sides. In use, the first section and a portion of the second section protrude from the water above the water surface 101 and comprise an upper buoyant hull 102. The hull 102 sits atop a further inwardly tapering frusto-conical section from which a further substantially vertical cylindrical column extends vertically, to form an internal crude oil cargo tank 103. The cargo tank 103 extends, in use, vertically down into the water from beneath the hull 102 to form the ballast keel 104. One or more heave plates 105 extend horizontally on the outside surface of the keel 104 and are horizontally spaced apart from each other. A first heave plate is proximate the bottom of the keel 104 such that the wave loading on said keel is reduced whilst retaining the added mass and motion damping effects. Further heave plates 105 may be positioned above said first heave plate. Damping effects may be enhanced by perforating the plates 105 and ensuring there is a gap between the plate 105 and the hull 102 such that water can flow through and or around said plate 105. Flow in this manner generates turbulent vortices from the edges of the plates 105 which provide a damping effect.

Mooring equipment 106 may be located on the upper most deck 107 of the hull 102 with mooring lines 108 running vertically alongside said hull 102 and through external fairleads 109 located at some convenient vertical position. Flow-lines and riser bundles 110 rise from the seabed to the production facility located on the upper deck 107 and, in the first embodiment, attach to a manifold arrangement on said upper deck 107. A main process topsides facility 111 is located above the upper deck 107.

A single oil-over-water storage tank 112 is housed internally, within the FPSO 100 and about the axial centre of the second, third and fourth sections of said FPSO 100. The storage tank 112 extends from the keel 104, substantially the height of said FPSO 100. This is shown in FIG. 2.

The storage tank 112 forms a single tank volume. A central water caisson 113 runs vertically through the axial centre of the storage tank 112 and is open at its lowest level to said storage tank 112. One or more submerged water pumps and risers 114 may be used to pump or inject water at the lowest point of the water caisson 113 via a lower sump (not shown). Said risers 114 are positioned such that the tank may be completely emptied for inspection.

In use, the oil-over-water storage tank 112 contains oil 112*a* and seawater 112*b*. The oil 112*a* sits atop the water 112*b* by virtue of said oil 112*a* having a lower specific gravity. Accordingly, an interface 115, between the two liquids is formed which moves up and down as the oil 112*a* is drawn into the storage tank 112, or offloaded therefrom.

The central water caisson 113 is open to the atmosphere at the end proximate the upper deck 107 and said central water caisson 113 is open to the lower portion of the storage tank 112 at the end proximate the keel 104. The caisson 113 contains water to a level suitable to maintain the desired pressure in the storage tank 112.

The buoyant hull 102 further comprises internal spaces 116 which surround the upper portion of the storage tank 112. The internal spaces 116 are formed by the outer skin 122 of the storage tank 112 and surrounding outer hull shell plating 117 of the hull 102. These internal spaces 116 may be further divided with internal collision bulkheads 118 to assist with watertight subdivision of said spaces 116 in the event of ship collision and breach of the hull 102.

A crude oil caisson 119 extends vertically upwards from the top of the oil storage tank 112 to the main process topsides facility 111 located above the upper deck 107 and is substantially open to atmosphere. In this way, the levels of liquid in the oil caisson 119 and water caisson 113 are connected hydrostatically. The water caisson 113 and risers 114 also extend through the upper deck 107 and connect to produced water treatment facilities (not shown).

The third section of the FPSO comprises water ballast tanks 120. Said tanks 120 are provided around at least the storage tank 112 and are used to compensate for variations in the mass, and centre of mass, of fluids within said storage tank 112, caused by the difference in density between crude oil 112*a* and sea-water 112*b*. The water ballast tanks 120 are provided proximate the height of the centre of mass of the storage tank 112 and define the lowest point of the hull 102. The centre of mass of the oil storage tank 112 moves up and down as the level of the interface 115 between the oil and water moves from the top to the bottom of said tank 112. When the storage tank 112 is full of oil or full of water, the centre of mass of said tank 112 is approximately in the middle of said tank 112. Therefore, operation of the tank 112 in the pressed full condition minimises movement of the centre of mass. The change in centre of mass is only affected by the difference in the specific gravity between the oil 112*a* and the water 112*b* which is relatively small. This enables ballast tanks 120 positioned at approximately half the height of the tank 112 to be used at first as the oil 112*a* displaces the water 112*b* and the centre of mass of the tank 112 moves downwards. Ballast tanks 120 positioned below the half height of the oil storage tank 112 are used once the centre of mass of the tank 112 starts to rise back to the mid-point of said tank 112 later during the filing cycle.

Fixed solid ballast 121 is located proximate the keel 104, beneath the first crude oil storage tank 112. The solid ballast 121 is located proximate the lowest point of the keel 104 to compensate for the mass of the topsides located at the highest point of the FPSO 100. The amount of fixed ballast is such that the centre of mass of the FPSO 100 is at or just below the centre of bouyancy. Too much fixed ballast, i.e. overcompensating for the mass of the topsides, would create a need for more buoyancy, which increases the water-plane area and decreases the natural heave period. It would also increase the steel weight and cost.

Figure 3:
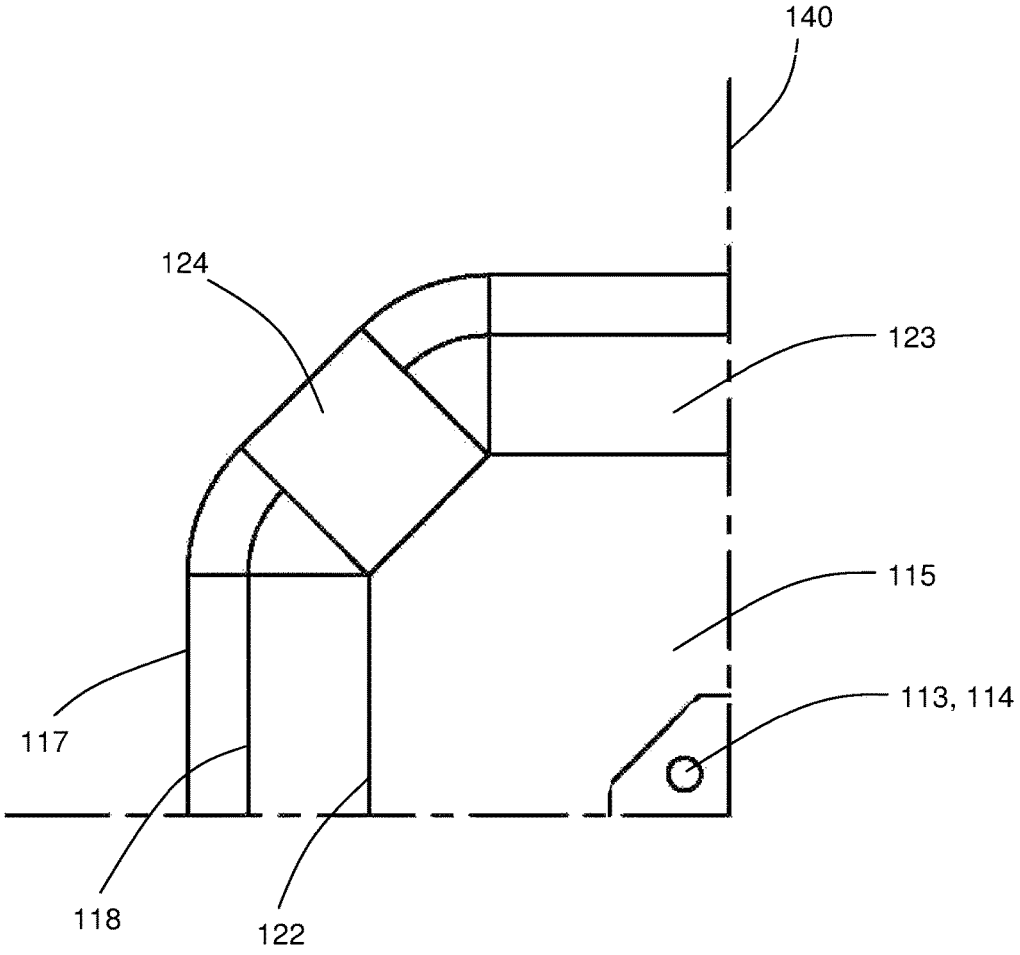
FIG. 3 is a quarter plan view of section A-A of FIG. 2.

FIG. 3 shows a quarter plan view of section A-A of the FPSO 100. It can be seen that the upper deck 107 is octagonal and symmetric about axis 140, with circular fairings between flat sections. It will, of course, be apparent to the skilled person that the upper deck may have an alternative number of sides, for example, twelve or sixteen, whilst remaining substantially symmetric about axis 140. The oil storage tank 112, also known as an oil-over-water tank, is shown in the centre of the plan view of FIG. 3 around the water caisson 113 and riser 114. The outer skin 122 and the hull shell plating 117 form the internal spaces 116 as described above and the inner collision bulkheads 118 are also shown in plan view in FIG. 3. Further spaces 123, 124 are arranged about the oil storage tank 112 to aid buoyancy, provide general access and equipment storage space, and or provide routes for piping, chain lockers, or similar.

Figure 4:
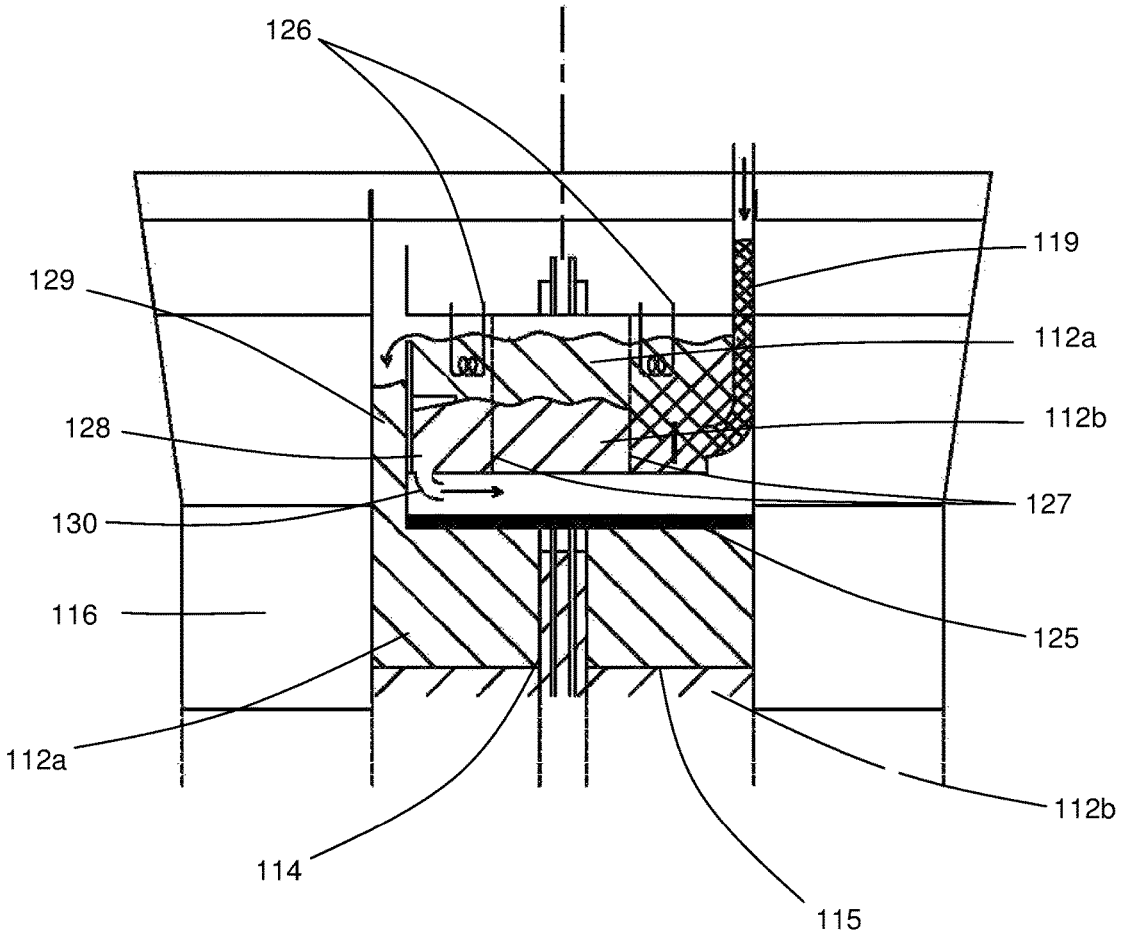
FIG. 4 is a partial side view of a second embodiment of the present invention.

A second embodiment of the invention is shown in FIG. 4. In this embodiment, the upper portion of the central oil storage tank 112 is used to provide space for an oil-water separation cell or plurality of cells. The top of the storage tank 112 forms the base of the space provided for the separation cell or cells. The space extends up to proximate the upper deck 107 and across the width of the tank 112.

Degassed production fluids are transferred from the topsides facility 111, as before, via the caisson 119 through which fluid levels and pressures are managed. The cell or cells are of sufficient overall volume to provide a long enough residence time based on the daily fluids production rate—to ensure the separation of the oil 112*a* and water 112*b* through gravity. Insulation and or heating elements 126 may be provided such that the temperature of the contents of the cell or cells may be controlled according to the specific needs of the fluids being separated. Each cell may be comprised of a series of baffles and weirs 127, arranged to form a sequence of zones 128 through which the production fluids may be directed such that the oil 112*a* has sufficient time to rise and separate from the water 112*b* and may be skimmed off the top and transferred to a further oil caisson 129 used to supply the storage tank 112 beneath. The water is taken off at the lower level, shown in FIG. 4 as via water caisson 130, and transferred to a suitable water clean-up facility on the topsides 111. Such an arrangement enables oil 112*a* to spill from the cell or cells into the oil filled caisson 129, with an equivalent amount of water 112*b* being removed from the water caisson 130 to allow the oil 112*a* to fill the tank 112.

Spaces may in addition be provided to provide over-flow or slops tank in case of production interruptions or fluctuations that may from time to time need to be managed.

One or more such cells may be in use at any one time, with the facility to take cells in and out of production to allow cleaning, inspection or other activities as may be required from time to time.

In this way, the amount of topsides oil-water separation equipment may be reduced, and/or fields that have a very high proportion of water to oil, may be exploited more readily.

For certain oil-fields, it may be that the bulk of oil and gas processing is carried out elsewhere on a fixed or floating platform, or subsea. A third embodiment of this invention may therefore be so arranged as to provide an oil storage and export facility only, or, in combination with the second embodiment, minimal processing or conditioning such as water removal and treatment.

In this third embodiment, there may be no requirement to provide a topsides structure or permanent manning, with all equipment located within the upper deck structure of the facility. However, in all other aspects of function and design of this embodiment, it is the same as described above.

In each embodiment, the dimensions of the FPSO are tailored to the required oil storage capacity, topsides weight, static stability requirements and operability constraints on motions in waves. For example, for 200 k to 250 kbbl oil storage, the total draft from the water surface to the lowest point would typically vary between approximately 60 m to 90 m, and the maximum width of the upper hull section would vary between approximately 38 m and 45 m. The freeboard (i.e. the waterline to the deck edge) of the apparatus in use would be chosen to be between approximately 15 m and 20 m. The internal oil storage 112 tank runs from approximately the lowest point to around 10 m above the external waterline and, when viewed from above, is approximately 20-25 m across.

The present invention is not limited to the specific embodiments described above. Alternative arrangements will be apparent to a reader skilled in the art.

The invention claimed is:

1. An oil storage apparatus, comprising:

a buoyant hull having a single column of circular or polygonal cross-section, said hull having a diameter and an interior that includes at least one oil-over-water tank, means for maintaining said tank in pressed full condition, wherein a first region of the hull is, in use, proximate the waterline, and a second region of the hull is, in use, distal from the waterline, wherein the diameter of said hull reduces from a maximum at the first region to a minimum at the second region, further comprising at least one oil-water separation cell positioned proximate the upper most portion of the oil-over-water storage tank, wherein the at least one separation cell is of sufficient volume to ensure, in use, separation of the oil and water therein through gravity, at least one baffle or weir arranged in the separation cell to form at least one zone through which, in use, oil and water may flow, and an oil caisson fluidly connecting the at least one separation cell with the oil-over-water storage tank, wherein the separation cell further comprises a heating arrangement and insulation.

2. An oil storage apparatus according to claim 1, wherein the single column comprises two or more vertically stacked cylinders.

3. An oil storage apparatus according to claim 1, wherein the apparatus comprises a center of buoyancy and a center of mass, wherein the apparatus is arranged such that the center of buoyancy and center of mass are substantially coincident.

4. An oil storage apparatus according to claim 1, wherein the at least one oil-over-water tank has a center of mass and is enclosed and isolated from the external atmosphere.

5. An oil storage apparatus according to claim 4, wherein at least one water ballast tank is provided proximate the center of mass, below the center of mass, or above the center of mass of the oil-over-water tank.

6. An oil storage apparatus according to claim 1, wherein the oil-over-water tank is provided about the central vertical axis of said hull.

7. An oil storage apparatus according to claim 1, further comprising a water caisson which is in fluid communication with the oil-over-water tank, the water caisson is arranged so as to enable control of the pressure in the oil-over-water tank, wherein the water caisson extends through an upper most deck of the hull to connect to water treatment facilities located thereon.

8. An oil storage apparatus according to claim 7, wherein the water caisson is arranged such that, in use, water displaced from the oil-over-water tank is not exposed directly to the sea, wherein the displaced water is cleaned and or used for water injection.

9. An oil storage apparatus according to claim 1, further comprising a crude oil caisson which fluidly connects the oil-over-water tank to a main process topsides facility.

10. An oil storage apparatus according to claim 1, wherein the buoyancy of the hull is provided by internal spaces arranged around the oil-over-water tank.

11. An oil storage apparatus according to claim 10, further comprising collision bulkheads provided within the internal spaces such that watertight subdivision of said spaces is possible.

12. An oil storage apparatus according to claim 1, further comprising at least one water ballast tank provided around the oil-over-water tank.

13. An oil storage apparatus according to claim 1, further comprising a keel provided beneath the hull, at least one substantially horizontally oriented heave plate adapted to be perforated arranged on or proximate to the keel, and fixed solid ballast positioned proximate the keel.

14. An oil storage apparatus according to claim 1, wherein, in use, the draft from the water surface to the base of the keel is between substantially 60 and 90 meters, wherein the maximum width of the hull is between substantially 38 and 45 meters;

wherein the freeboard of the apparatus in use is between substantially 15 and 20 meters;

wherein the oil-over-water tank runs from proximate the base of the FPSO to, in use, substantially 10 meters above the waterline;

wherein the oil-over-water tank is approximately 20 to 25 meters in width when viewed from above; and wherein the height of an upper most deck of the hull is between substantially 75 and 110 meters.

15. An oil storage apparatus according claim 1, wherein the water-plane area of the hull is such that, in combination with the displaced mass, hydrodynamic mass, and damping, natural periods in heave and pitch degrees of freedom are maintained at or above substantially 20 seconds.

16. A method of using an oil storage apparatus according to claim 1, including a buoyant hull having a single column of circular or polygonal cross-section and an interior including at least one oil-over-water tank, the method comprising the step of:

maintaining the oil drawn into the oil-over-water tank in pressed full condition so that a first region of the hull is, in use, proximate the waterline, and a second region of the hull is, in use, distal from the waterline, the diameter of said hull reducing from a maximum at the first region to a minimum at the second region.

17. A method according to claim 16, further comprising the step of using an internal water caisson to manage the pressure in the oil-over-water tank.

18. A method according to claim 16, further comprising the steps of:

cleaning the water displaced from the oil-over-water tank; using the cleaned water for water injection.

* * * * *